US006071167A

United States Patent [19]

Yang

[11] Patent Number: 6,071,167

[45] Date of Patent: Jun. 6, 2000

[54] TOY THAT GENERATES ROLLING MOVEMENT

[75] Inventor: Chieh-Te Yang, Tainan, Taiwan

[73] Assignee: Dah Yang Toy Industrial Co., Ltd., Tainan, Taiwan

[21] Appl. No.: 09/229,924

[22] Filed: Jan. 13, 1999

[51] Int. Cl.[7] ..... A63H 33/00

[52] U.S. Cl. ..... 446/236; 446/431; 446/437

[58] Field of Search ..... 446/236, 279, 446/431, 437, 457, 462; 119/700, 701, 702, 704

[56] References Cited

U.S. PATENT DOCUMENTS

| | | | |
|---|---|---|---|
| 3,500,579 | 3/1970 | Bryer | 446/462 |
| 3,788,277 | 1/1974 | Willinger et al. . | |
| 3,994,262 | 11/1976 | Suchowski et al. . | |
| 4,571,204 | 2/1986 | Wang | 446/236 |

FOREIGN PATENT DOCUMENTS

| | | | |
|---|---|---|---|
| 2410022 | 9/1975 | Germany | 446/462 |

*Primary Examiner*—Robert A. Hafer
*Assistant Examiner*—Jeffrey D. Carlson
*Attorney, Agent, or Firm*—Akin, Gump, Strauss, Hauer & Feld, L.L.P.

[57] ABSTRACT

A toy includes a spherical outer casing, a circular coupling ring, a support member, a base and an inner toy body. The coupling ring is disposed around the outer casing, and is mounted pivotally on the outer casing about a first pivot axis that extends along a diameter of the outer casing. The support member has a plate portion with first and second end portions, and a pair of spaced-apart arm portions extending from the first end portion of the plate portion. The arm portions flank the coupling ring, and are mounted pivotally on the coupling ring about a second pivot axis that extends along a diameter of the coupling ring and that is perpendicular to the first pivot axis. The base engages releasably the support member, and is adapted to be supported on a horizontal surface for disposing the outer casing above the horizontal surface. The inner toy body is disposed in the outer casing, and is in frictional contact with an inner surface of the outer casing. The inner toy body is movable in the outer casing to result in rolling movement of the outer casing relative to the coupling ring about the first pivot axis.

9 Claims, 7 Drawing Sheets

TOY THAT GENERATES ROLLING MOVEMENT

BACKGROUND OF THE INVENTION

This invention relates to a toy that generates rolling movement, more particularly to a toy having a base which can suspend a spherical outer casing above a horizontal surface in different ways and which permits rolling movement of the spherical outer casing.

FIG. 1 illustrates a conventional rolling toy which includes a transparent spherical outer casing 10 and an inner toy body 12 disposed in the outer casing 10. A driving unit (not shown) is provided in the inner toy body 12 to drive movement of the inner toy body 12 and to result in rolling movement of the outer casing 10. However, after being popular for years, this type of rolling toy has lost its appeal and has become less attractive to consumers.

SUMMARY OF THE INVENTION

Therefore, the object of the present invention is to provide a toy which generates rolling movement in different ways.

Accordingly, the toy of the present invention includes a spherical outer casing, a circular coupling ring, a support member, a base, and an inner toy body. The coupling ring is disposed around the outer casing, and is mounted pivotally on the outer casing about a first pivot axis that extends along a diameter of the outer casing. The support member has a plate portion with first and second end portions, and a pair of spaced-apart arm portions that extend from the first end portion of the plate portion. The arm portions flank the coupling ring, and are mounted pivotally on the coupling ring about a second pivot axis that extends along a diameter of the coupling ring and that is perpendicular to the first pivot axis. The base engages releasably the support member, and is adapted to be supported on a horizontal surface for disposing the outer casing above the horizontal surface. The inner toy body is disposed in the outer casing, and is in frictional contact with an inner surface of the outer casing. The inner toy body is movable in the outer casing to result in rolling movement of the outer casing relative to the coupling ring about the first pivot axis.

BRIEF DESCRIPTION OF THE SEVERAL VIEWS OF DRAWINGS

Other features and advantages of the present invention will become apparent in the following detailed description of the preferred embodiments with reference to the accompanying drawings, in which.

DETAILED DESCRIPTION OF THE INVENTION

Figure 1:
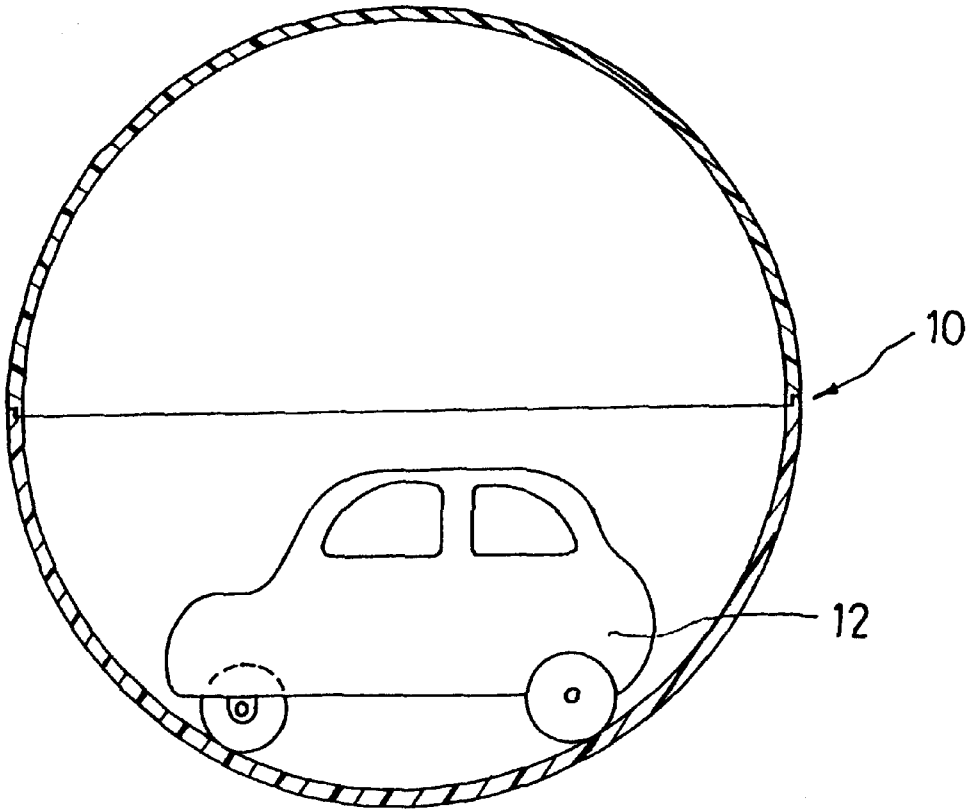
FIG.1 PRIOR ART
FIG. 1 is a schematic view illustrating a conventional rolling toy.
Figure 2:
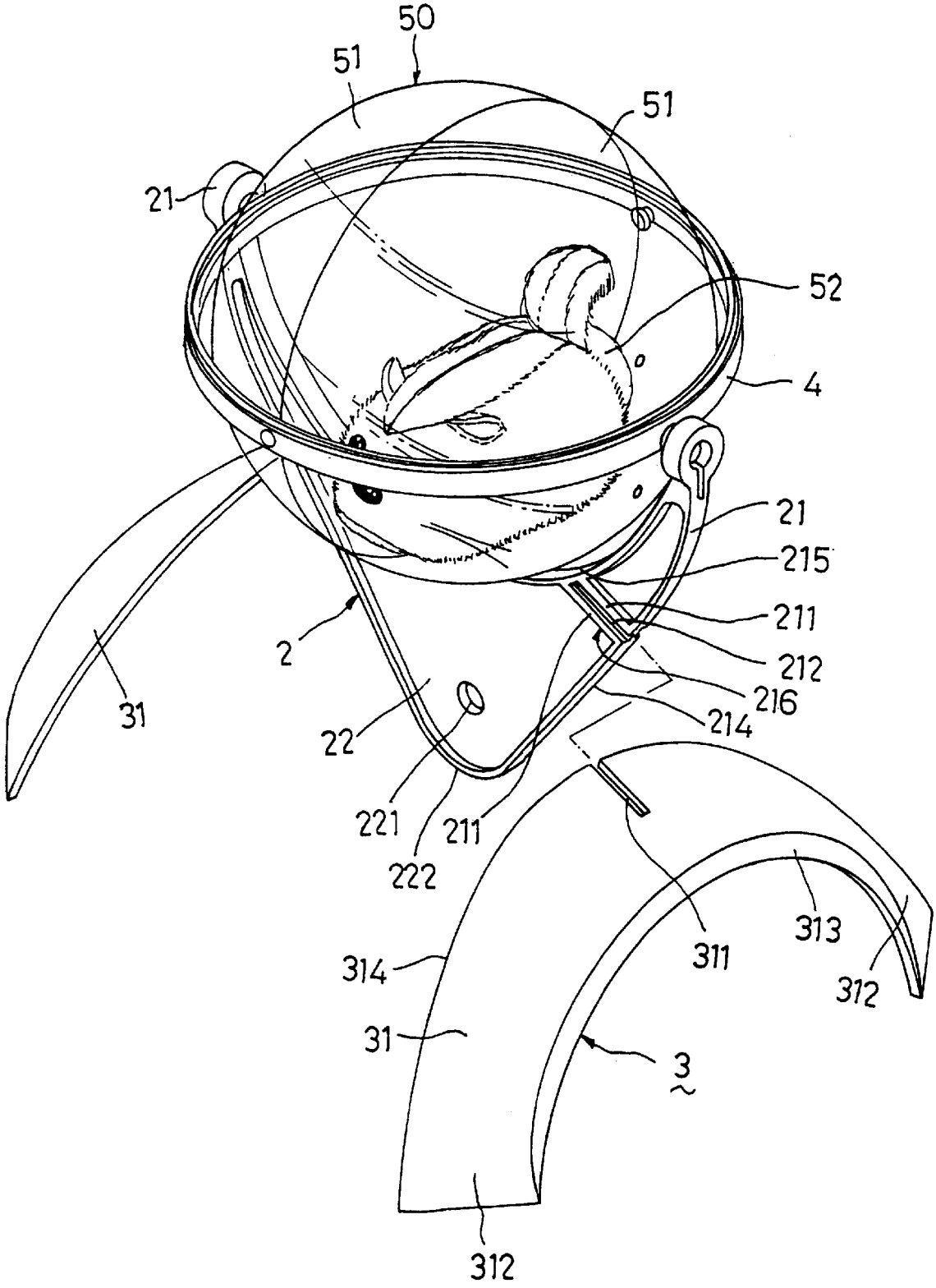
FIG. 2 is a partly exploded, perspective view of a toy according to a first preferred embodiment of the present invention.
Figure 3:
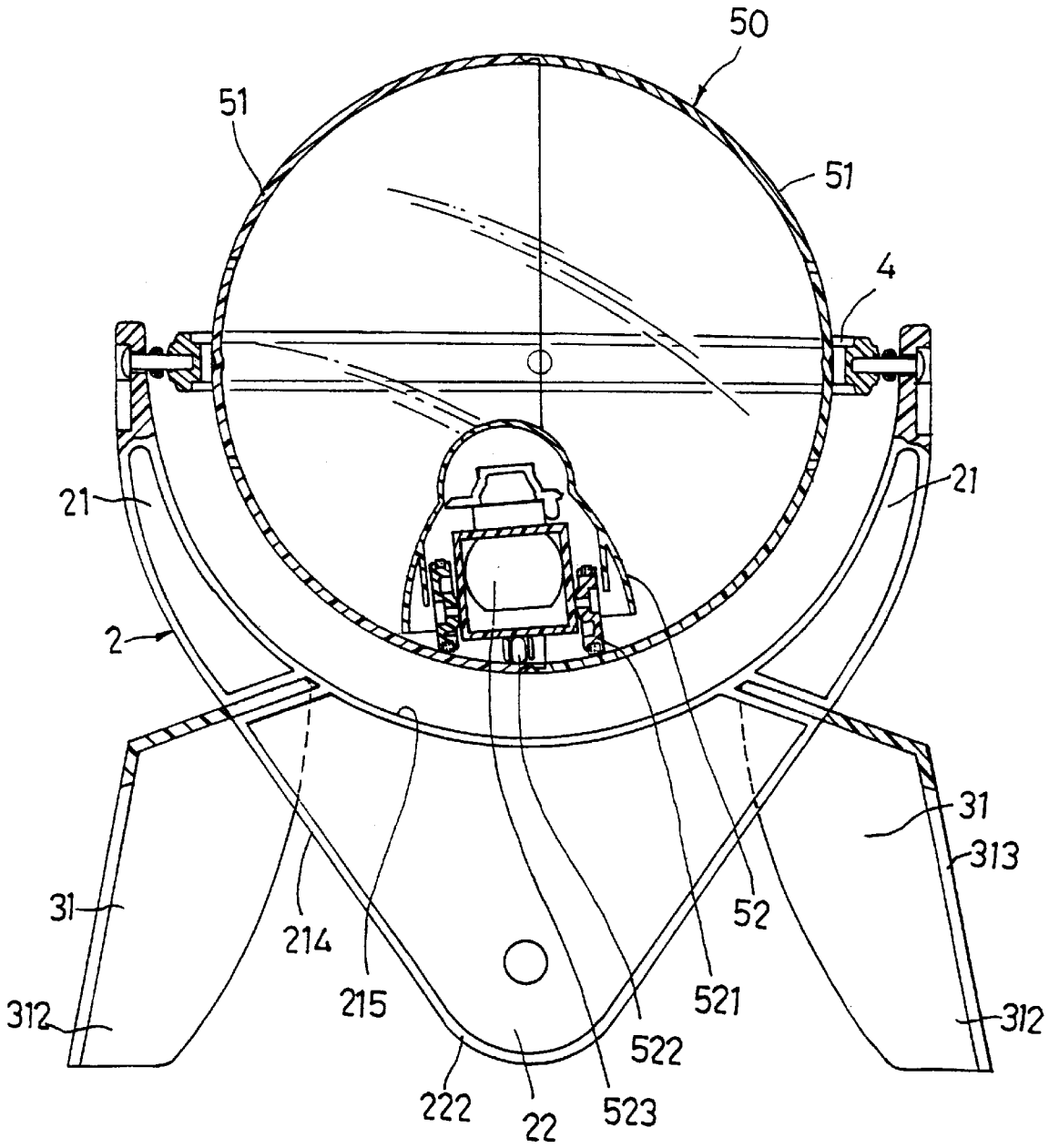
FIG. 3 is partly sectioned, elevational view of the toy of the first preferred embodiment.

Referring to FIGS. 2 and 3, the toy of the first preferred embodiment according to the present invention is shown to include a transparent spherical outer casing 50, a circular coupling ring 4, a support member 2, a base 3, and an inner toy body 52.

The transparent spherical outer casing 50 includes two complementary hemispherical casing parts 51 which engage one another and which cooperatively confine an interior space therebetween.

The coupling ring 4 has a diameter slightly larger than that of the outer casing 50, and is disposed around the outer casing 50. The coupling ring 4 is mounted pivotally on the outer casing 50 about a first pivot axis that extends along a diameter of the outer casing 50.

The support member 2 has a generally V-shaped outer periphery 214, a generally semi-circular inner periphery 215 disposed around the outer casing 50, a generally triangular plate portion 22 with a wider first end portion proximate to the outer casing 50 and a narrower second end portion formed with a rounded corner portion 222, and a pair of spaced arm portions 21 which extend from the first end portion of the plate portion 22 in a direction away from the corner portion 222 and which flank the coupling ring 4. The arm portions 21 have distal ends that are spaced apart from one another by a distance greater than the diameter of the coupling ring 4. The plate portion 22 is formed with a hanging hole 221. Each of the arm portions 21 has an engaging portion 216 which is formed with a parallel pair of abutment strips 211 on front and back sides of the support member 2. The abutment strips 211 on each side extend from the inner periphery 215 to the outer periphery 214 so as to define a retaining groove 212 between the abutment strips 211 on the same side of the support member 2. The distal ends of the arm portions 21 of the support member 2 are mounted pivotally on the coupling ring 4 about a second pivot axis that extends along a diameter of the coupling ring 4 and that is perpendicular to the first pivot axis. The base 3 includes a pair of curved support plates 31 disposed on two lateral sides of the support member 2 adjacent to the arm portions 21, respectively. Each of the support plates 31 has a generally inverted U-shaped structure with two downwardly extending leg portions 312 which are adapted to be supported on a horizontal surface, an inner edge 314 facing the other one of the support plates 31, and a flat outer edge 313 opposite to the other one of the support plates 31. Each of the support plates 31 is formed with a retaining slit 311 which extends from the inner edge 314 toward the outer edge 313 and which is formed between the leg portions 312. The retaining slit 311 permits extension of the engaging portion 216 of a respective one of the arm portions 21 of the support member 2 thereinto such that a periphery of the retaining slit 311 extends into the retaining grooves 212 in a respective arm portion 21 of the support member 2 and such that the abutments strips 211 abut against top and bottom sides of the support plates 31 so as to engage the support plates 31 releasably with the support member 2. The outer casing 50 can thus be supported by the support plates 31 above the horizontal surface.

Figure 4:
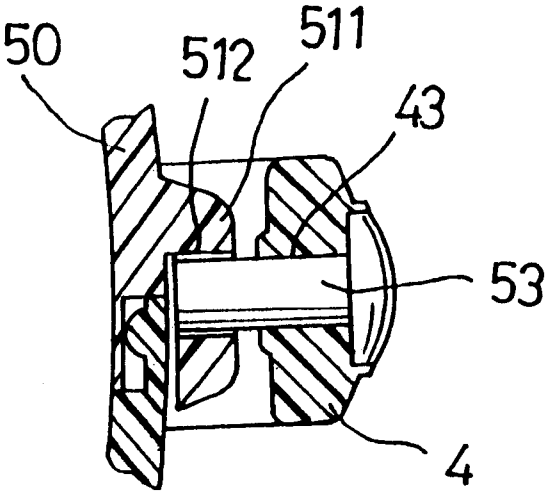
FIG. 4 is an enlarged fragmentary sectional view illustrating the connection between a coupling ring and a spherical outer casing of the toy of the first preferred embodiment.

Referring to FIG. 4, the coupling ring 4 is mounted pivotally on the outer casing 50 with the use of a pair of first pivot shafts 53 (only one is shown). Each of the first pivot shafts 53 extends in the direction of the diameter of the outer casing 50 through a radial mounting hole 43 formed in the coupling ring 4 and into a pivot hole 512 formed in a pivot lobe 511 that extends from the outer casing 50. The first pivot shafts 53 are tightly retained in the mounting holes 43 and are loosely retained in the pivot holes 512 to permit pivoting of the coupling ring 4 relative to the outer casing 50 about the first pivot axis.

Figure 5:
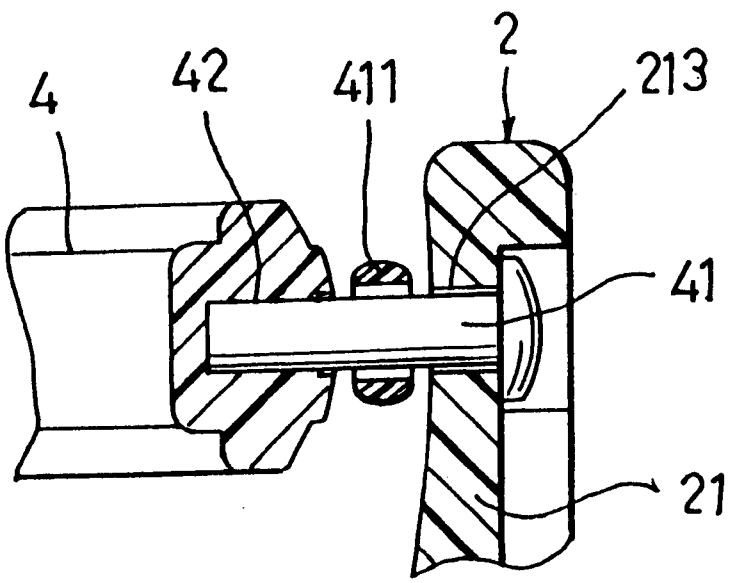
FIG. 5 is an enlarged fragmentary sectional view illustrating the connection between the coupling ring and a support member of the toy of the first preferred embodiment.

Referring to FIG. 5, similarly, the distal ends of the arm portions 21 of the support member 2 are mounted pivotally on the coupling ring 4 with the use of a pair of second pivot shafts 41 (only one is shown). Each of the second pivot shafts 41 extends in the direction of the diameter of the coupling ring 4 through a pivot hole 213 formed in a respective arm portion 21 and through a mounting hole 42 formed in the coupling ring 4. The second pivot shafts 41 are loosely retained in the pivot holes 213 and are tightly retained in the mounting holes 42 to permit pivoting of the coupling ring 4 relative to the support member 2 about the second pivot axis. Preferably, a spacer member 411 is sleeved on a respective one of the second pivot shafts 41, and is disposed between the coupling ring 4 and the respective arm portion 21 of the support member 2 to keep the coupling ring 4 spaced apart from the arm portions 21 of the support member 2.

Referring once again to FIG. 3, the inner toy body 52 is disposed in the outer casing 50, and has a bottom side provided with a front wheel 522 at a front end portion thereof, and a pair of eccentric rear wheels 521 at a rear end portion thereof. The front wheel 522 is supported on an inner surface of the outer casing 50, and is turnable leftward and rightward freely. The rear wheels 521 are disposed on left and right sides of the inner toy body 52 and are in frictional contact with the inner surface of the outer casing 50. The rear wheels 521 are mounted respectively on two opposite ends of a transmission shaft 523 at opposite off-center positions relative to each other. When the transmission shaft 523 is driven by a driving unit (not shown) mounted in the inner toy body 52 to result in rotation of the eccentric wheels 521, the inner toy body 52 moves in the outer casing 50 to result in pivoting movement of the outer casing 50 relative to the coupling ring 4 about the first pivot axis. In addition, due to the eccentric wheels 521 provided on the inner toy body 52, the inner toy body 52 inclines leftward and rightward alternatingly during movement thereof to shift its weight center leftward and rightward alternatingly. The coupling ring 4 can thus be moved pivotally relative to the support member 2 about the second pivot axis.

Figure 6:
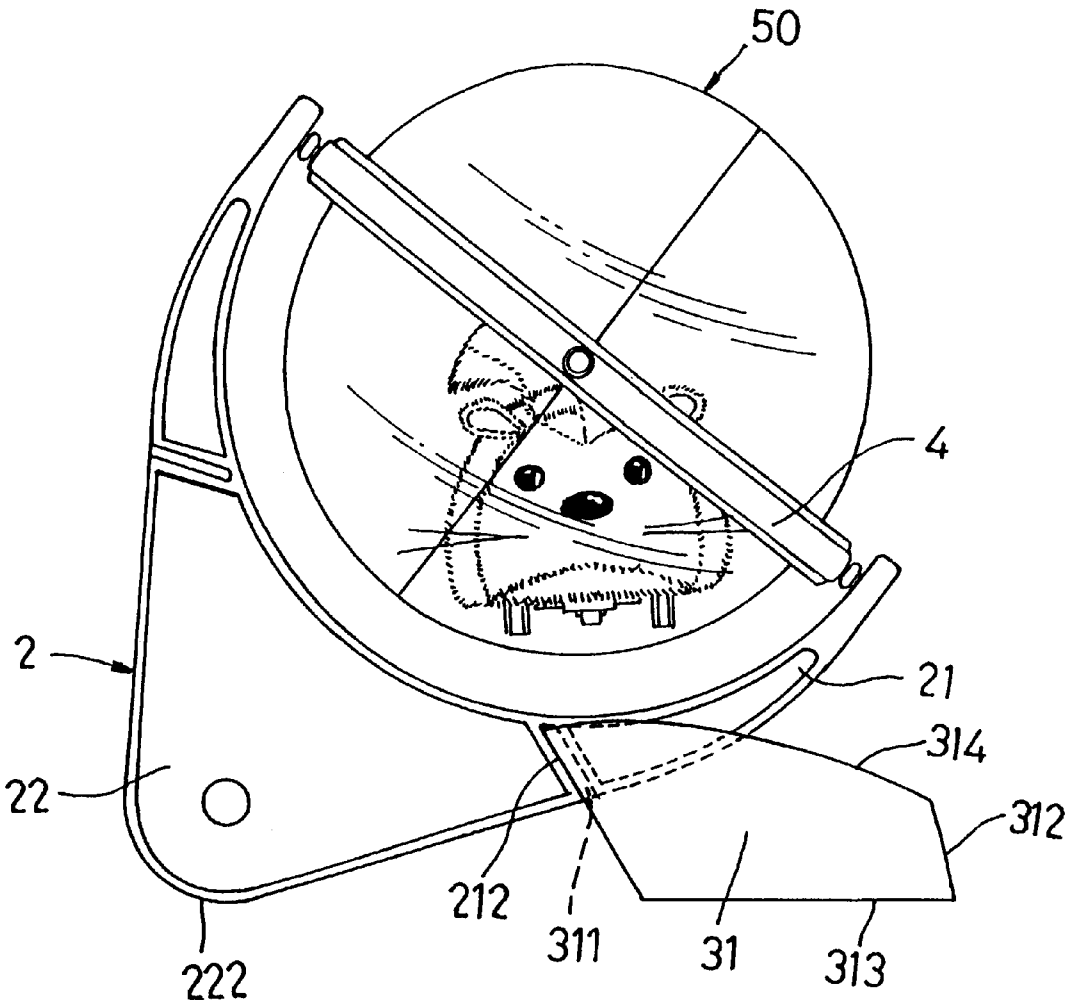
FIG. 6 is an elevational view illustrating the toy of the first preferred embodiment, where only one support plate is employed.

Referring to FIG. 6, the spherical outer casing 50 may be supported in a different manner to result in a different visual effect. As shown, the outer casing 50 may be supported on the horizontal surface by the support member 2 and only one of the support plates 31. The support plate 31 engages releasably one of the arm portions 21 of the support member 2 in a manner similar to that described hereinabove. However, the flat outer edge 313 serves as a bottom edge that rests on the horizontal surface, while the inner edge 314 serves as a top edge. In this manner, the support member 2 cooperates with the support plate 31 to support the outer casing 50 by contacting the rounded corner portion 222 of the support member 2 and the flat bottom edge 313 of the support plate 31 with the horizontal surface.

Figure 7:
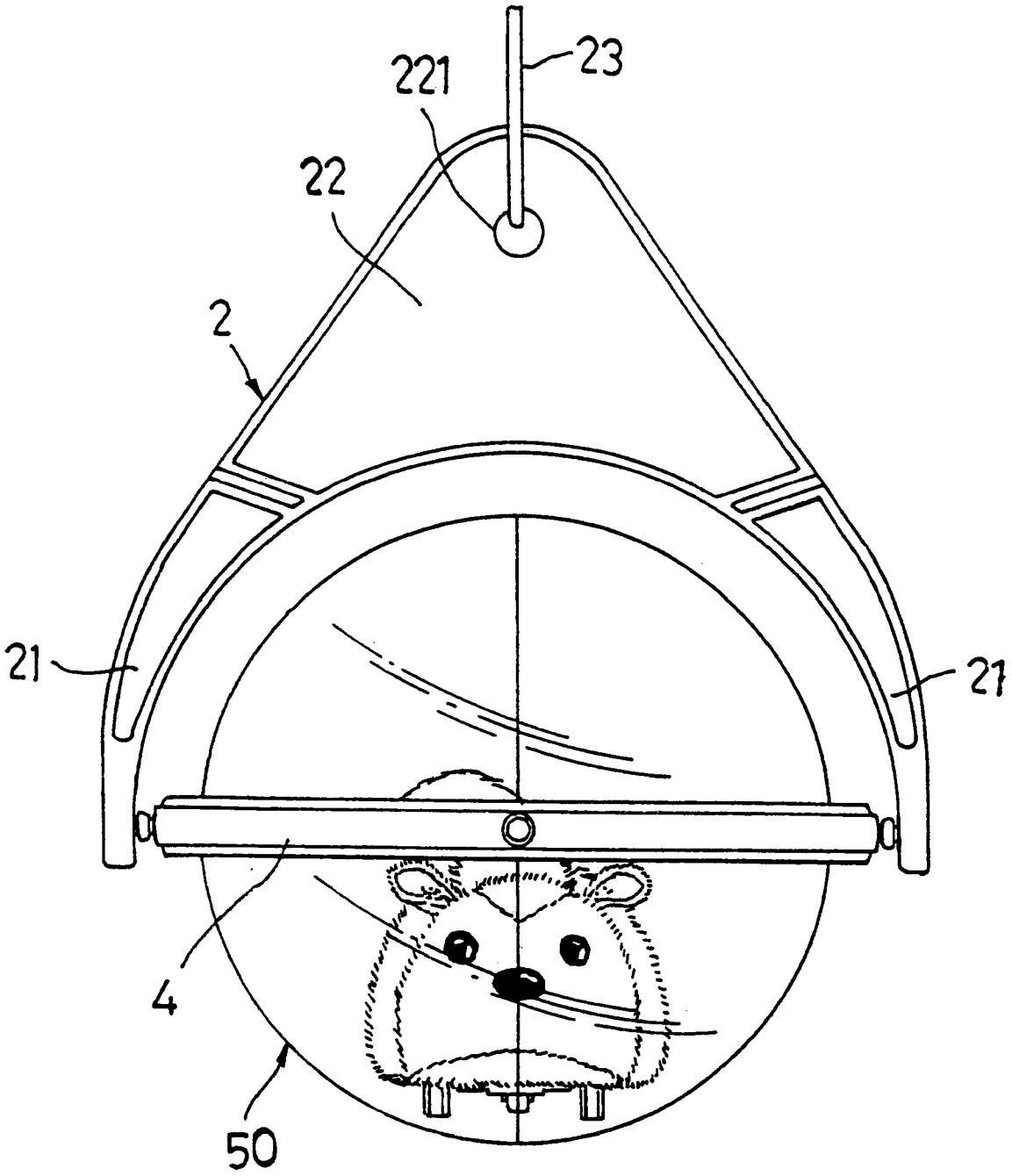
FIG. 7 is an elevational view illustrating the toy of the first preferred embodiment, where an outer casing of the toy is in a hanging state.

Referring to FIG. 7, the outer casing 50 may be removed from the support plates 31 and may be hung in the air by extending a hanger, such as a hanging string 23, through the hanging hole 221 in the plate portion 22 of the support member 2. At this time, the support member 2 is turned upside down such that the arm portions 21 extend downwardly to carry the outer casing 50. The pair of support plates 31 can thus be omitted.

Therefore, by varying the arrangement of the support member 2 and the support plates 31, the outer casing 50 can be suspended above a horizontal surface in different ways to attain different visual effects and added fun.

Figure 8:
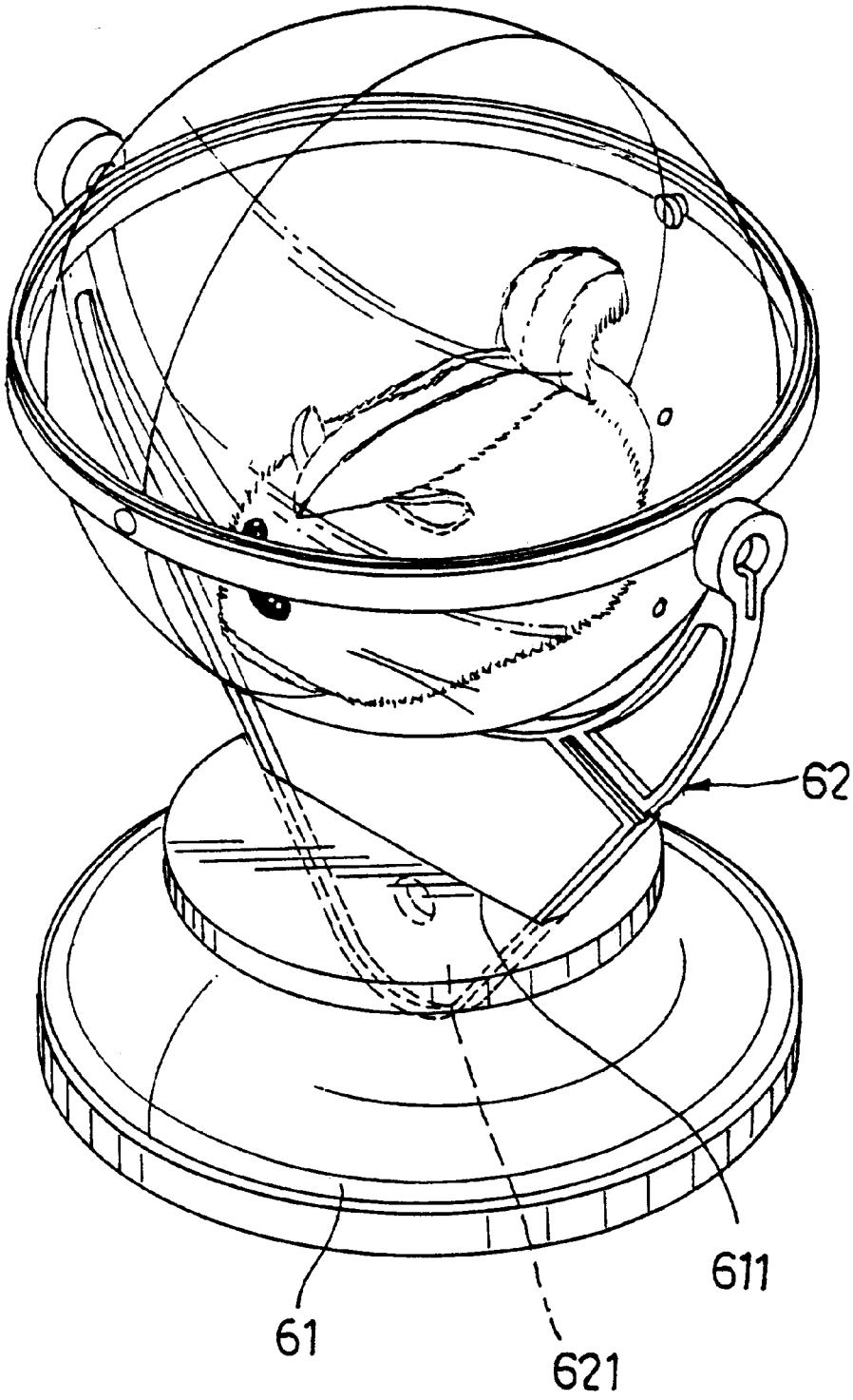
FIG. 8 is a perspective view illustrating the toy according to a second preferred embodiment of the present invention.

Referring to FIG. 8, in a second preferred embodiment, the support member 62 is supported on a circular platform 61. The platform 61 has a bottom side adapted to be supported on a horizontal surface, and a top side formed with an insert slit 611. The narrower second end portion of the generally triangular plate portion 621 of the support member 62 is inserted removably into the insert slit 611 to engage releasably the platform 61.

Preferably, the inner toy body 52 of the toy of the present invention can be provided with a sound-responsive control circuit associated with the driving unit such that the driving unit can be activated to start movement of the inner toy body 52 when the outer casing 50 is tapped and such that the driving unit can be deactivated to cease movement of the inner toy body 52 after operating for a period of time, such as two minutes.

With this invention thus explained, it is apparent that numerous modifications and variations can be made without departing from the scope and spirit of this invention. It is therefore intended that this invention be limited only as indicated in the appended claims.

I claim:

1. A toy that generates rolling movement, comprising:

a spherical outer casing having an inner surface;

a circular coupling ring disposed around said outer casing, and mounted pivotally on said outer casing about a first pivot axis that extends along a diameter of said outer casing;

a support member having a plate portion with first and second end portions, and a pair of spaced-apart arm portions extending from said first end portion of said plate portion, said arm portions flanking said coupling ring and being mounted pivotally on said coupling ring about a second pivot axis that extends along a diameter of said coupling ring and that is perpendicular to said first pivot axis;

a base engaging releasably said support member and adapted to be supported on a horizontal surface for disposing said outer casing above the horizontal surface; and an inner toy body disposed in said outer casing, said inner toy body being in frictional contact with said inner surface of said outer casing and being movable in said outer casing to result in rolling movement of said outer casing relative to said coupling ring about said first pivot axis.

2. The toy according to claim 1, wherein said inner toy body has left and right sides, and a transmission shaft which has two opposite ends provided respectively with eccentric wheels that are in frictional contact with said inner surface of said outer casing, said eccentric wheels being disposed respectively on said left and right sides and being mounted on said transmission shaft at different off-center positions relative to each other, the weight center of said inner toy body shifting leftwardly and rightwardly during movement of said inner toy body so as to enable said outer casing to move said coupling ring to pivot relative to said support member about said second pivot axis.

3. The toy according to claim 1, wherein said plate portion of said support member is formed with a hanging hole therethrough so as to permit hanging of said toy above the horizontal surface.

4. The toy according to claim 1, wherein said base includes a pair of generally inverted U-shaped support plates mounted on said arm portions of said support member, respectively, each of said support plates having two downwardly extending leg portions adapted to be supported on the horizontal surface, an inner edge facing the other one of said support plates, and an outer edge opposite to the other one of said support plates, each of said support plates being formed with a retaining slit between said leg portions, said retaining slit extending from said inner edge toward said outer edge, each of said arm portions of said support member having an engaging portion which extends into said retaining slit in a respective one of said support plates for engaging releasably the respective one of said support plates.

5. The toy according to claim 4, wherein each of said support plates has top and bottom sides, said retaining slit extending from said top side through said bottom side, said engaging portion of each of said arm portions of said support member being formed with two spaced-apart abutment strips which abut respectively against said top and bottom sides of the respective one of said support plates when said engaging portion extends into said retaining slit.

6. The toy according to claim 1, wherein said base includes a support plate with an upper edge and a flat lower edge, said support plate being formed with a retaining slit that extends from said upper edge toward said lower edge, one of said arm portions of said support member having an engaging portion which extends into said retaining slit to engage releasably said support plate, said lower edge of said support plate being adapted to be placed on the horizontal surface and cooperating with said plate portion of said support member to support said outer casing above the horizontal surface.

7. The toy according to claim 6, wherein said plate portion of said support plate has a generally V-shaped outer periphery with a corner portion formed at said second end portion, said corner portion cooperating with said support plate to support said outer casing above the horizontal surface.

8. The toy according to claim 6, wherein said support plate has opposite first and second sides, said retaining slit extending from said first side through said second side, said engaging portion of said support member being formed with two spaced-apart abutment strips which abut respectively against said first and second sides of said support plate when said engaging portion extends into said retaining slit.

9. The toy according to claim 1, wherein said base includes a platform with a bottom side adapted to be supported on the horizontal surface, and a top side formed with an insert slit, said second end portion of said plate portion of said support member being inserted removably into said insert slit to engage releasably said platform.

* * * * *